US009932187B2

(12) United States Patent
Mugica Irastorza et al.

(10) Patent No.: US 9,932,187 B2
(45) Date of Patent: Apr. 3, 2018

(54) WINDING DEVICE AND METHOD

(71) Applicant: FAGOR, S. COOP, Arrasate-Mondragon (ES)

(72) Inventors: Imanol Mugica Irastorza, Tolosa (ES); Oscar Gonzalez Mora, Donostia (ES); Daniel Garcia Chueca, Donostia (ES)

(73) Assignee: FAGOR, S. COOP., Arrasate-Mondragon (ES)

( * ) Notice: Subject to any disclaimer, the term of this patent is extended or adjusted under 35 U.S.C. 154(b) by 156 days.

(21) Appl. No.: 15/010,135

(22) Filed: Jan. 29, 2016

(65) Prior Publication Data

US 2016/0221782 A1 Aug. 4, 2016

(30) Foreign Application Priority Data

Jan. 30, 2015 (EP) ..... 15382027

(51) Int. Cl.

| | |
|---|---|
| ***B65H 18/26*** | (2006.01) |
| ***B21C 47/32*** | (2006.01) |
| ***B65H 18/10*** | (2006.01) |
| *B21C 47/06* | (2006.01) |

(52) U.S. Cl.

CPC ..... *B65H 18/26* (2013.01); *B21C 47/326* (2013.01); *B65H 18/10* (2013.01); *B21C 47/06* (2013.01); *B21C 47/063* (2013.01)

(58) Field of Classification Search

CPC ..... B65H 18/10; B65H 18/26; B21C 47/326
See application file for complete search history.

(56) References Cited

U.S. PATENT DOCUMENTS

| | | | | |
|---|---|---|---|---|
| 3,905,218 A * | 9/1975 | Galletti | B21C 47/063 72/148 |
| 5,149,004 A * | 9/1992 | Sudau | B65H 18/26 242/529 |
| 6,186,438 B1 * | 2/2001 | Zeppenfeld | B21C 47/063 242/547 |

FOREIGN PATENT DOCUMENTS

| | | | |
|---|---|---|---|
| DE | 1801233 | A1 | 5/1970 |
| JP | 1987161425 | | 2/1988 |
| JP | 3790685 | B2 | 2/2003 |
| KR | 2019990025538 | A | 2/2000 |
| KR | 20130120927 | A | 11/2013 |

OTHER PUBLICATIONS

European Search Report in corresponding European Patent Application No. 15382027.9, dated Aug. 3, 2015.

* cited by examiner

*Primary Examiner* — Sang K Kim
(74) *Attorney, Agent, or Firm* — Edell, Shapiro & Finnan, LLC

(57) ABSTRACT

A winding device suitable for winding at least one strip on a mandrel. According to one embodiment the winding device includes a pressure assembly configured to press a strip against the surface of the mandrel when winding the strip. The pressure assembly comprises a first pressure unit which is coupled to and rotates together with the mandrel from a first winding position to a second winding position while the first pressure unit presses on the strip. The pressure assembly further comprises a second pressure unit that is attached to the first pressure unit, and that is configured for pressing on the strip when the first pressure unit reaches the second winding position, allowing forward movement of the strip in the winding direction when the mandrel rotates.

21 Claims, 14 Drawing Sheets

WINDING DEVICE AND METHOD

CROSS-REFERENCE TO RELATED APPLICATIONS

This application relates to and claims the benefit and priority to European Application No. 15382027, filed Jan. 30, 2015.

TECHNICAL FIELD

The present invention relates to winding devices and methods for winding strips.

BACKGROUND

Winding devices and methods for winding strips of material, particularly metal strips, on the rotary mandrel of a winding machine are known. Some of these devices are incorporated in the mandrel of the winding machine and consist of a longitudinal groove in the mandrel in which the end of one or more strips is introduced, the groove internally comprising jaws holding the ends of the strips. When the mandrel rotates for winding, it pulls the strips along and winds them on its surface.

Other devices for winding a strip are the so-called belt wrappers, consisting of mechanisms outside the mandrel of the winding machine, the mechanisms comprising an opening with a rough belt coupled to the mandrel. When the end of the strip or strips is arranged on the surface of the mandrel, the belt wrapper device is coupled, and when the mandrel starts to rotate, the strip is arranged between the surface of the mandrel and the belt of the device which also rotates in the same direction as the strip. The belt wrapper device therefore prevents backward movement of the strip and aids in winding same in the first turns thereof. The mandrel therefore lacks grooves on its surface and the end of the strip is not folded.

Document KR2013120927 A describes a winding device for winding a strip on a rotary mandrel of a winding machine, comprising a pressure assembly pressing the strip against the surface of the mandrel when winding the strip. The pressure assembly comprises a first pressure unit which is coupled to the shaft of the mandrel and rotates together with the mandrel, from a first winding position to a second winding position in the intersection with the strip, while the first pressure unit presses on the strip, and a plurality of additional pressure units pressing on the strip from different fixed angular positions with respect to the mandrel.

SUMMARY OF THE DISCLOSURE

One aspect of the disclosure relates to a winding device for winding strips suitable for winding at least one strip on a mandrel, comprising a pressure assembly pressing the strip against the surface of the mandrel when winding the strip. The pressure assembly comprises a first pressure unit which is coupled to and rotates together with the mandrel, from a first winding position to a second winding position in the intersection with the strip, while the first pressure unit presses on the strip.

The pressure assembly further comprises a second pressure unit which is attached to the first pressure unit and is configured for pressing on the strip upon the first pressure unit reaching the second winding position, allowing forward movement of the strip in the winding direction when the mandrel rotates.

Another aspect relates to a method for winding a strip on a rotary mandrel of a winding machine implemented with a winding device such as that described above.

Given that the first and the second pressure unit are physically attached, they remain in the same angular position with respect to one another. Thus, when the mandrel rotates, it pulls the first pressure unit along and with it the second pressure unit. Therefore, when the first pressure unit reaches the second winding position after having pulled the strip along, the second pressure unit is in the same angular position with respect to the first pressure unit. In this position, the second pressure unit moves to press on the strip, and after the operation the first pressure unit stops pressing on the strip, the second pressure unit allowing forward movement of the strip in the winding direction when the mandrel rotates. The strip is therefore wound by means of a device in which the number of parts used is reduced. In addition to being more economically competitive, a device that is compact, lightweight and easier to control is thus obtained. The process of assembling and disassembling the device is also simplified and made easier, which also contributes to cost reduction.

These and other advantages and features will become evident in view of the drawings and detailed description.

DETAILED DESCRIPTION

Winding processes for winding a strip of material, for example, a metal strip, in which the metal strip is wound after a transformation process, such as a longitudinal cutting process, for example, are known. In the longitudinal cutting process, the initial coil has a specific width and is cut into smaller widths, a plurality of coils having less width than the initial coil being generated. Each of the coils of the plurality of coils having the smaller width is wound at the same time on a rotary mandrel of a winding machine. This winding is performed with the aid of a device pressing the strips against the surface of the mandrel in first turns with tension less than the normal winding tension. After the first turns, the device is moves so as not to press on the strips and the tension of the strip is brought to the normal winding tension, and the mandrel is rotated until a complete winding of the strips is achieved.

Figure 1:
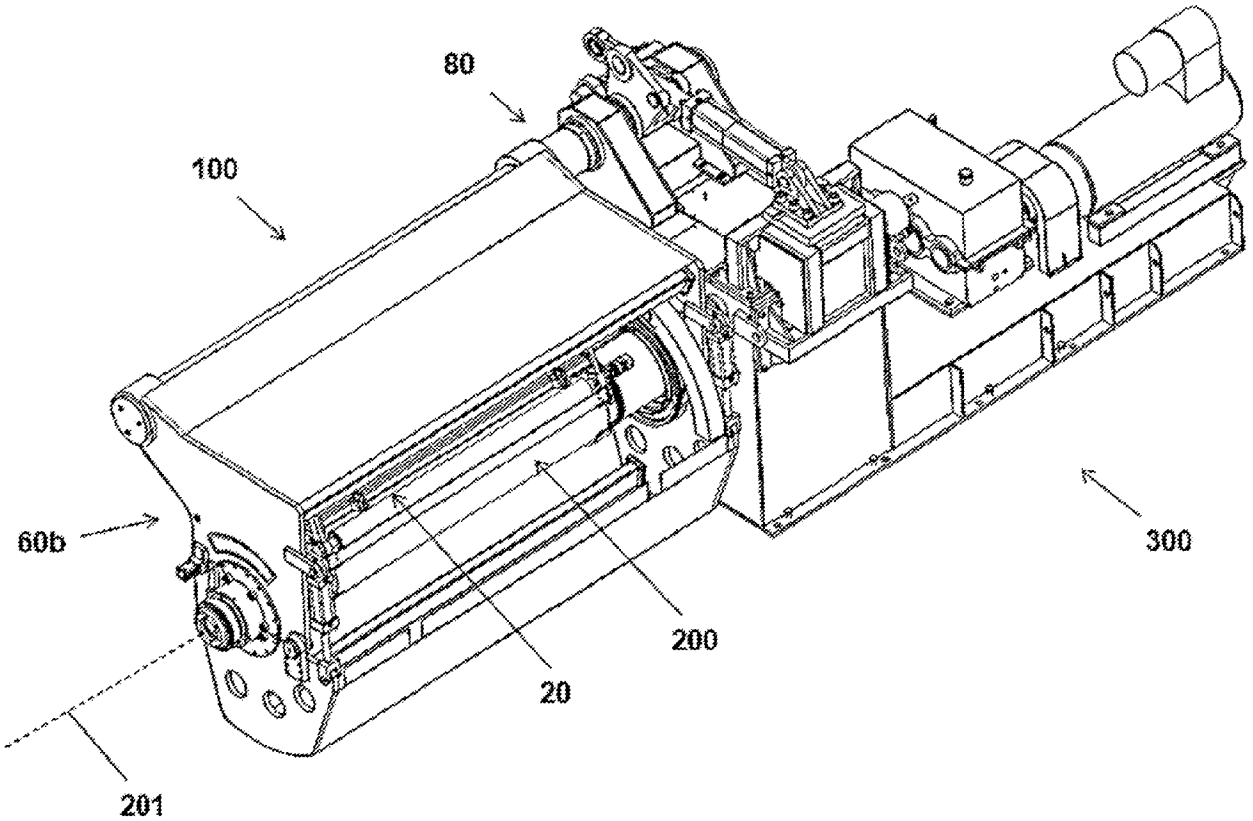
FIG. 1 shows a first perspective view of a winding device according to one embodiment.
Figure 2:
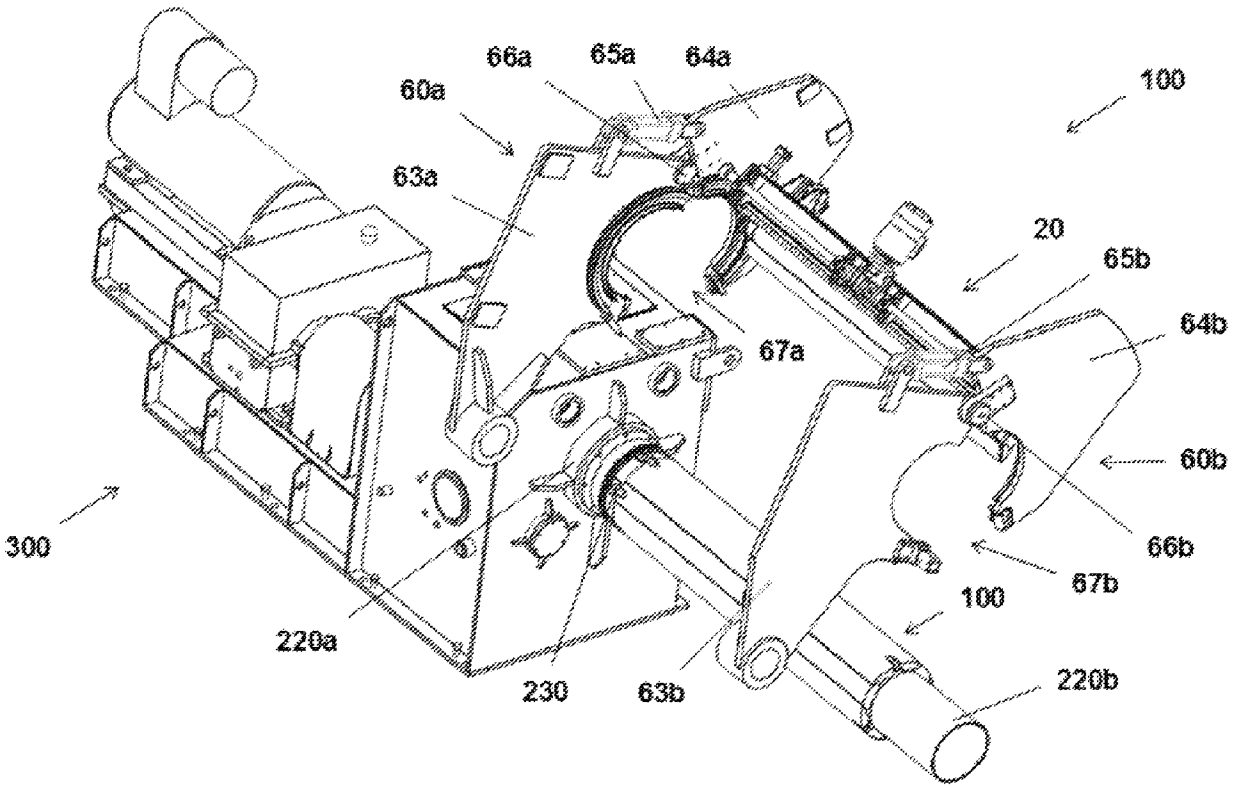
FIG. 2 shows a second perspective view of the device of FIG. 1, decoupled from the mandrel and without the articulated attachment.
Figure 3:
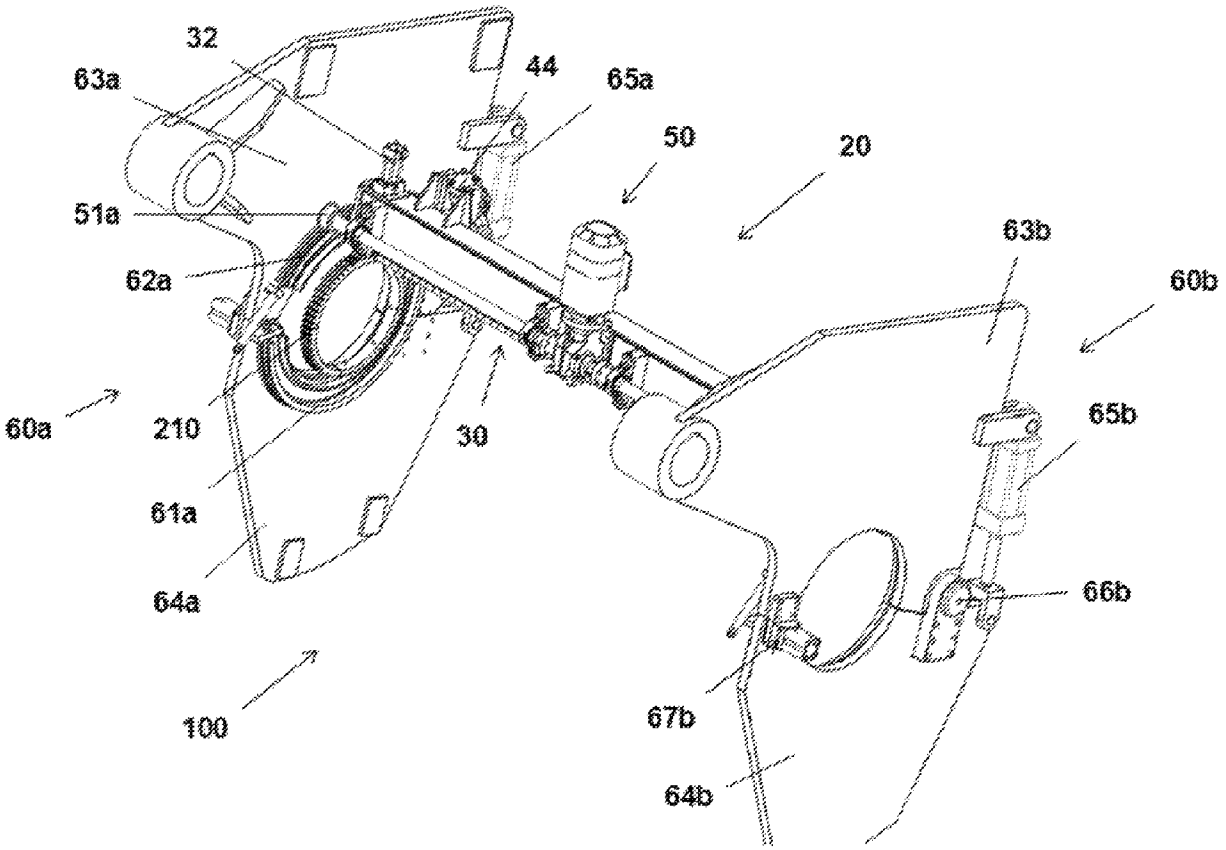
FIG. 3 shows a first perspective view of the device of FIG. 1, closed, without articulated attachment and incorporating meshing means of the mandrel.

FIG. 1 shows a first perspective view of an embodiment of a device 100 coupled to a mandrel 200 of a winding machine 300, the device 100 and the winding machine 300 being coupled by means of an articulated attachment 80. The mandrel 200 rotates about a central axis 201. FIG. 2 shows a second perspective view of the device 100 of FIG. 1, decoupled from the mandrel 200 and without the articulated attachment 80. FIG. 3 shows a first perspective view of the device 100 of FIG. 1, closed, without the articulated attachment 80, and incorporating meshing means 210 of the mandrel 200. And FIG. 4 shows a second perspective view of the device 100 of FIG. 3.

Figure 4:
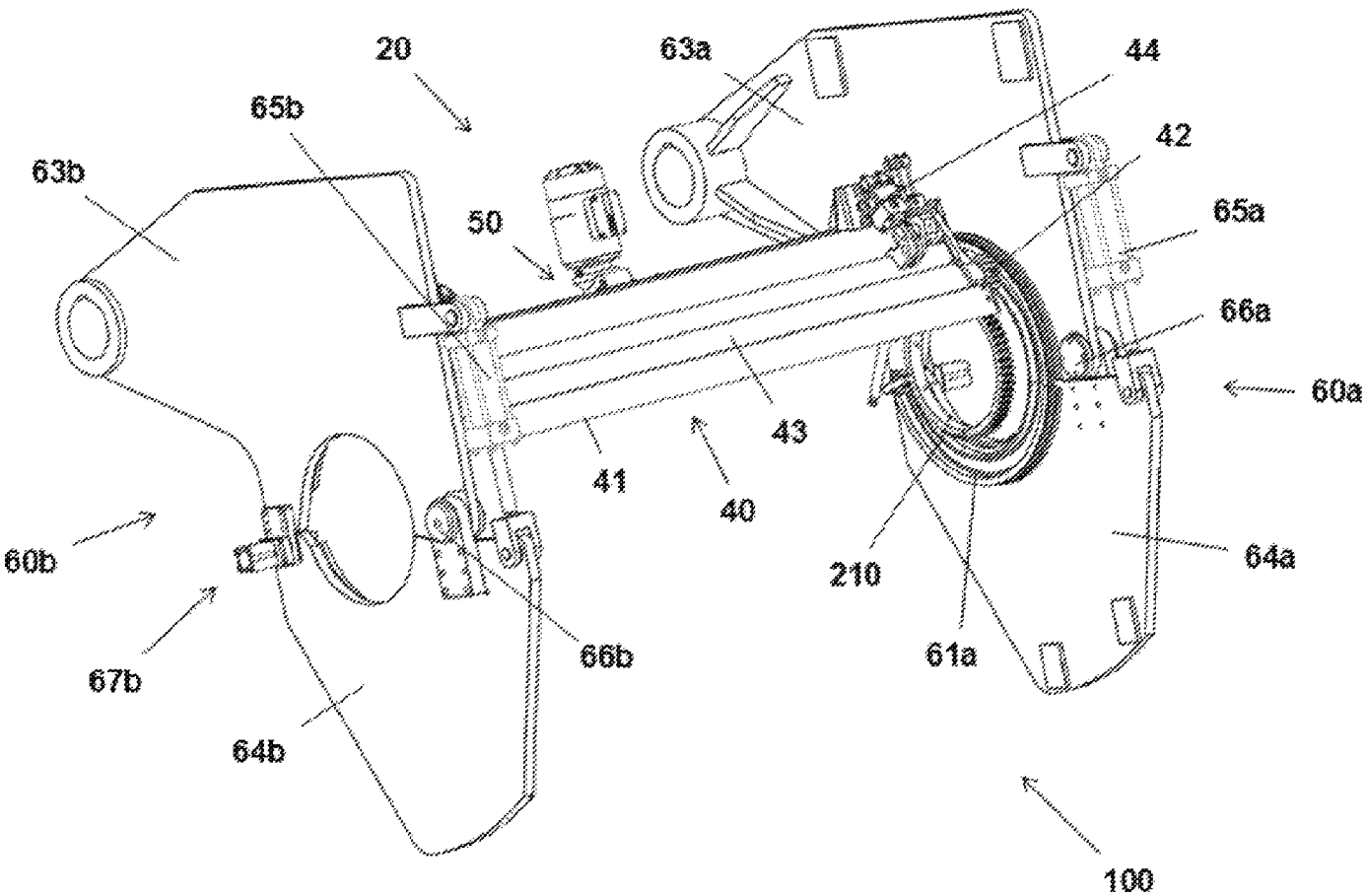
FIG. 4 shows a second perspective view of the device of FIG. 3.
Figure 12:
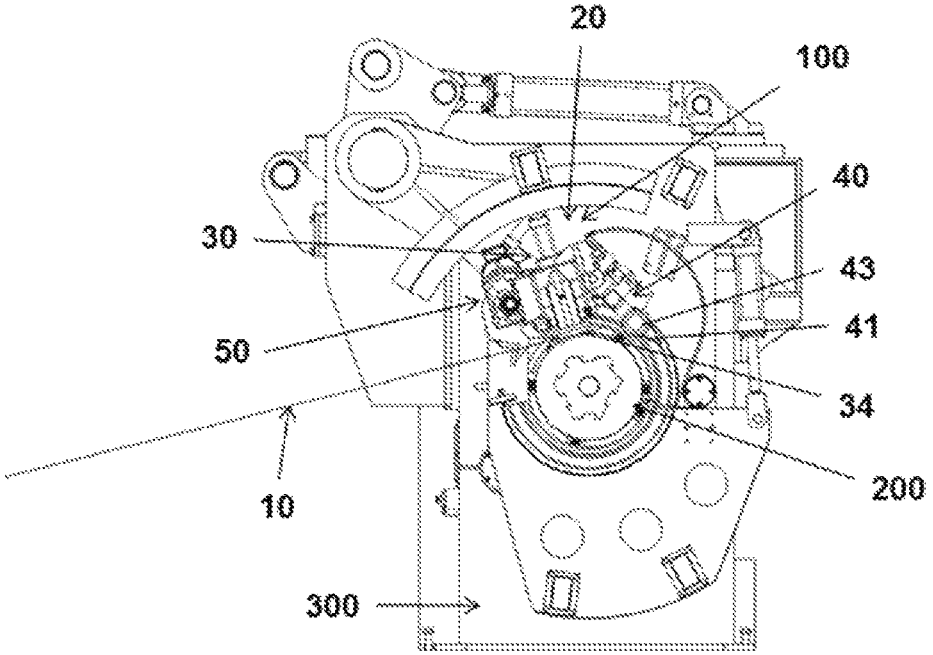
Figure 13:
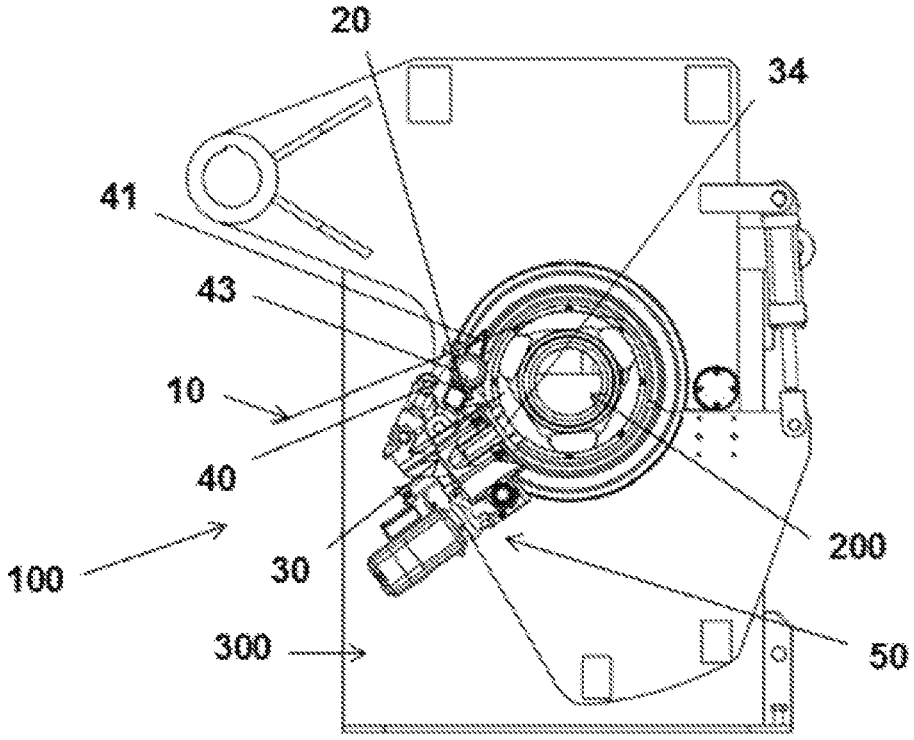
Figure 14:
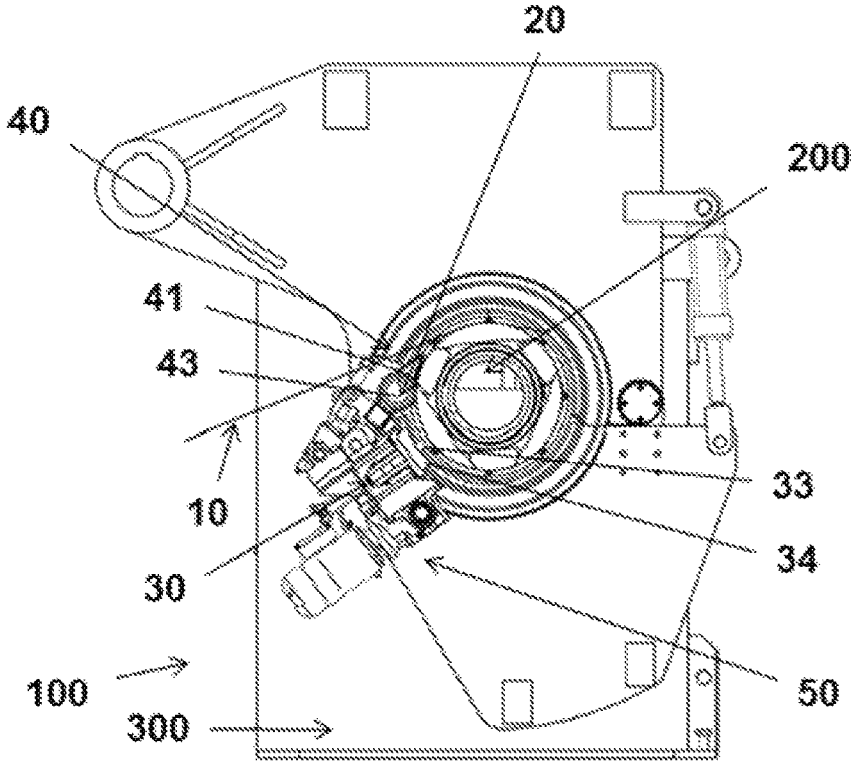
Figure 15:
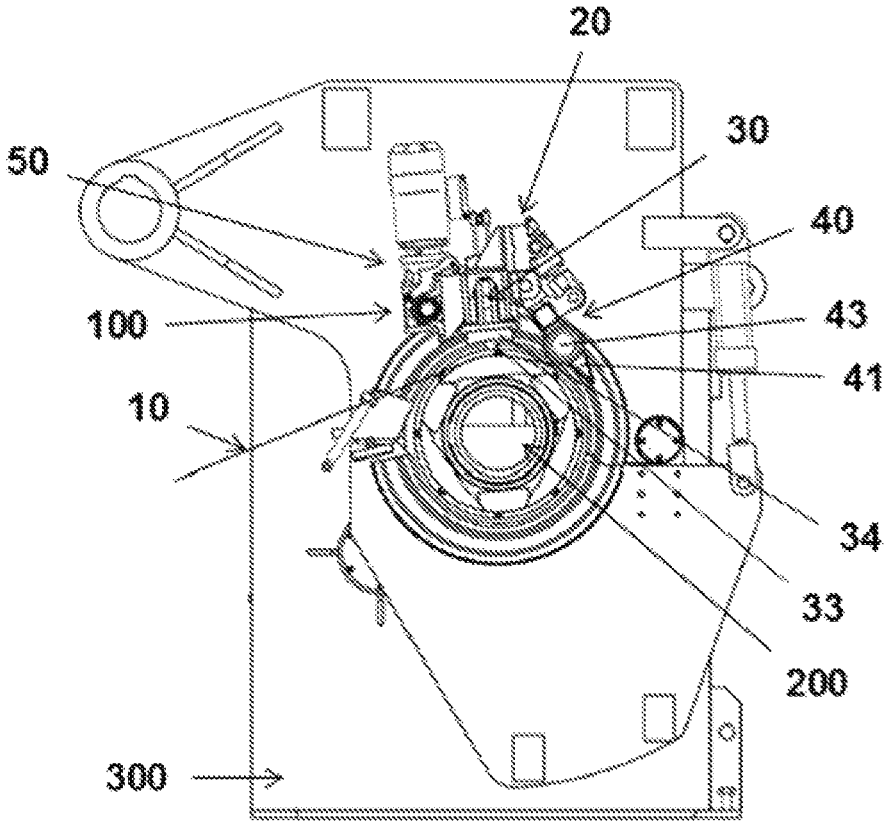

In the embodiment of the device 100 shown in FIGS. 3 and 4, the winding device 100 comprises a pressure assembly 20 which allows pressing the strip (as shown in FIGS. 12-14) against the surface of the mandrel 200 during an initial set of turns when winding the strip. The pressure assembly 20 comprises a first pressure unit 30 occupying, according to one embodiment, the length of the mandrel 200 on which the strip which is coupled. Initially an end portion of one or more strips is arranged supported on the mandrel 200. Initially, the first pressure unit 30 is in a first winding position in which it is in standby without pressing on the strip. Before rotating the mandrel 200 to start winding the strip, the first pressure unit 30 is moved to press the strip against the outer surface of the mandrel while also being coupled to the mandrel 200. As a result of being rotatably coupled to the mandrel 200, the first pressure 30 unit rotates with the mandrel 200. However, such rotation is limited to being less than 360 degrees and in some embodiments is rotated with the mandrel 200 to a position in which the first pressure unit 30 meets the strip that is being fed into the winding device, this being the second winding position.

The pressure assembly 20 comprises a second pressure unit 40 which is attached to the first pressure unit 30, and like the first pressure unit 30, may occupy the length of the mandrel 200 on which the strip can be supported. As a result of being attached to the first pressure unit 30, the second pressure unit 40 accompanies the first pressure unit 30 in its movement between the first and second winding positions. During the first pressure unit's rotation between the first and second winding positions the second pressure unit 40 does not press on the strip. However, upon the first pressure unit 30 reaching the second winding position the second pressure unit acts to press the strip against the mandrel 200 and the first pressure unit 30 subsequently stops pressing on the strip. The second pressure unit is configured to allow forward movement of the strip in the winding direction when as the mandrel 200 rotates beyond the second winding position. In this embodiment of the device 100, the second pressure unit 40 is arranged ahead of the first pressure unit 30 in the winding direction of the strip. The second pressure unit 40 comprises a guide/guiding means 41 which in the embodiment shown is a wedge which occupies the length of the mandrel 200 on which the strip can be supported. The sharp end of the wedge is arranged pointing in the winding direction of the strip and inclined towards the surface of the mandrel 200, and allows guiding the strip towards the surface of the mandrel 200.

Figure 5:
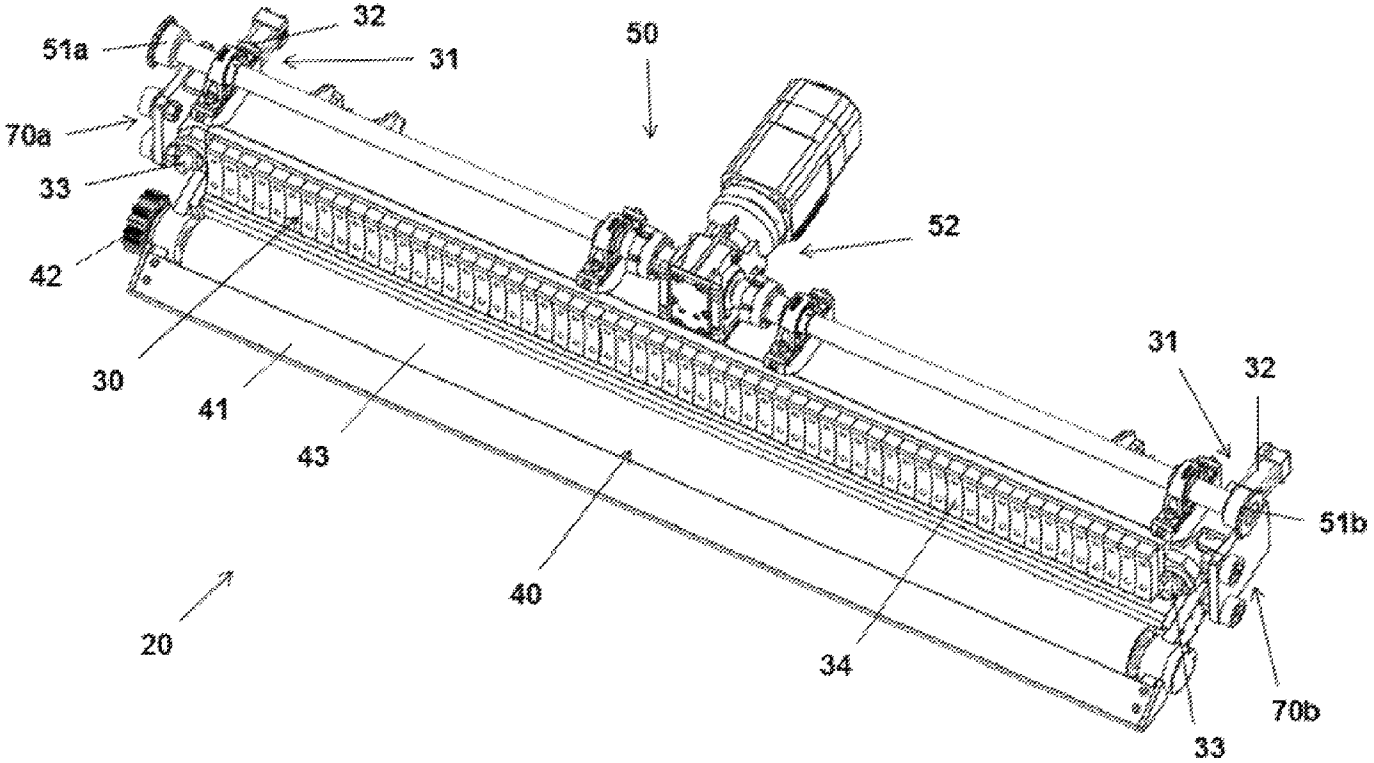
FIG. 5 shows a first perspective view of the pressure assembly of the device of FIG. 1.
Figure 6:
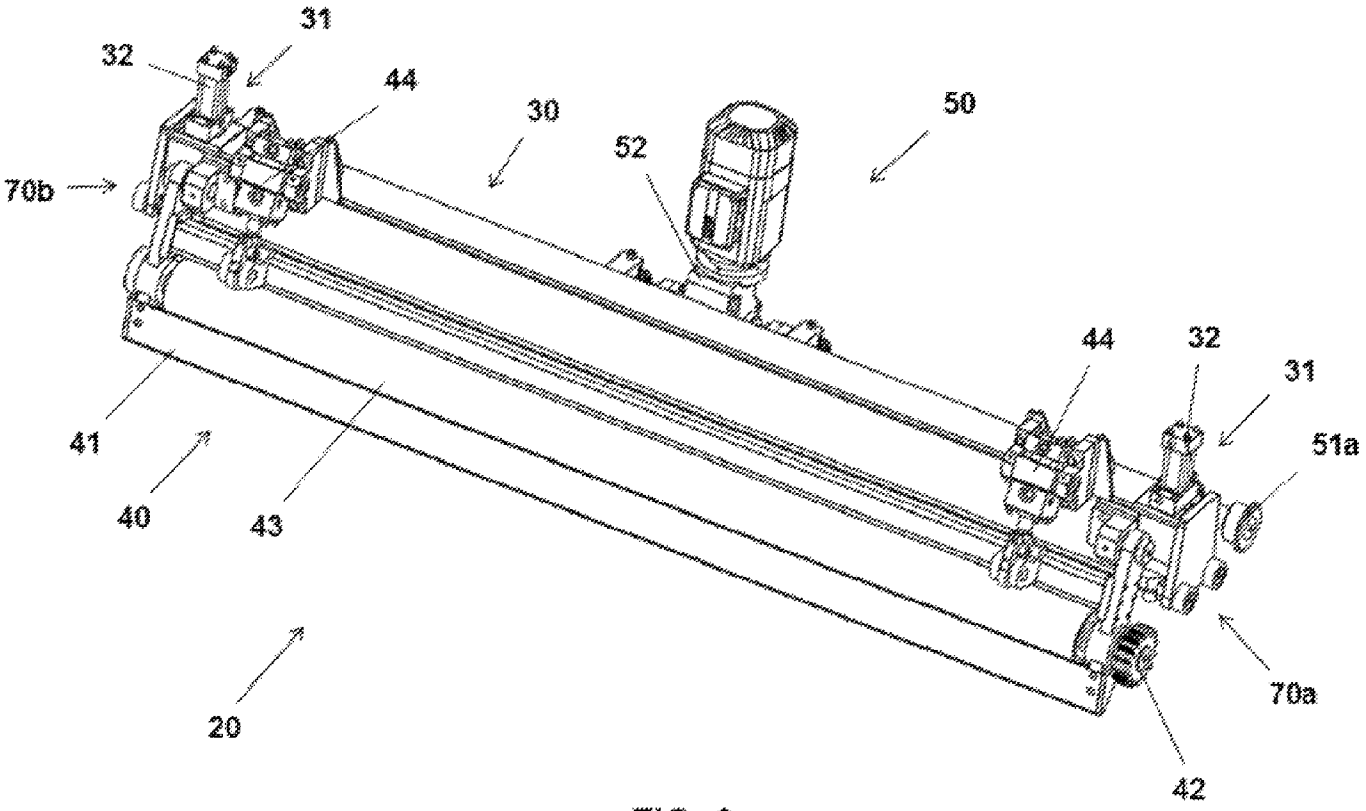
FIG. 6 shows a second perspective view of the pressure assembly of the device of FIG. 1.

FIG. 5 shows a first perspective view of the pressure assembly 20 of the device 100 of FIG. 1, and FIG. 6 shows a second perspective view of the pressure assembly 20 of the device 100 of FIG. 1. The first pressure unit 30 comprises coupling means 31 and a plurality of jaws 34 arranged longitudinally along the first pressure unit, like piano keys, forming a block pressing on the strips when the jaws 34 are operated. The coupling means 31 may be arranged at one or both ends of the first pressure unit 30 and includes an actuator assembly/movement means 32, which in the embodiment shown comprises a hydraulic cylinder at each end of the first pressure unit 30. The coupling means 31 further comprises one or more pins/insertion means 33 that are used to couple the first pressure unit 30 with the mandrel 200 as the mandrel is rotated between the first and second winding positions. Before winding starts (after an end portion of the strips are place supported on the outer surface of the mandrel 200) the actuator assembly/movement means 32 may be operated to move the plurality of jaws 34 to press against the strips and to also cause the one or more pins/insertion means 33 to engage with the mandrel 200 in a way that locks the rotation of the first pressure unit 30 with the rotation of the mandrel 200.

Figure 9:
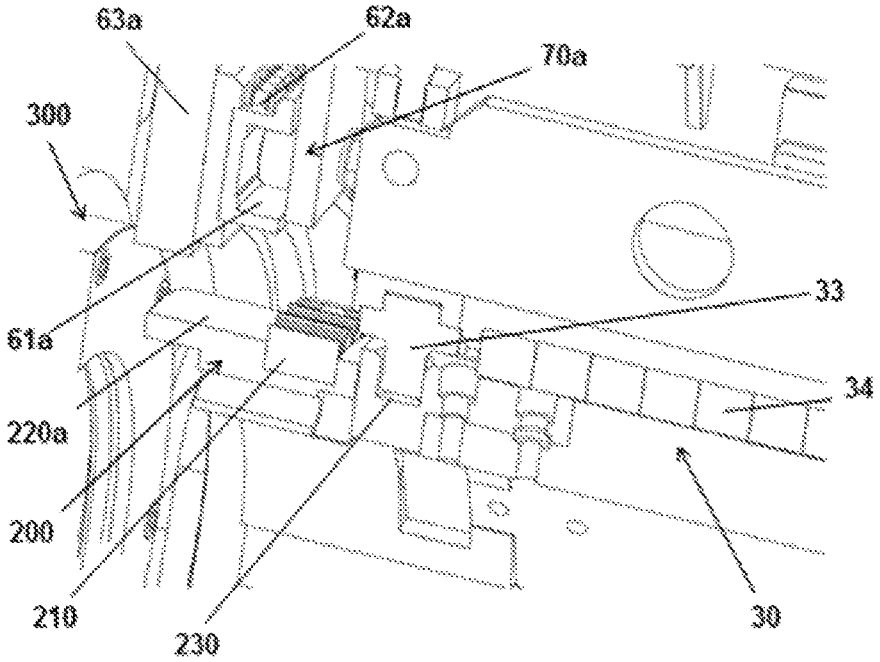
FIG. 9 shows a detailed view of the insertion means of the first pressure unit of the device of FIG. 1, coupled in a housing of the mandrel of FIG. 1.

FIG. 9 shows a detailed view of one embodiment of the insertion means 33 of the first pressure unit 30 of the device 100 of FIG. 1, coupled in a housing 230 of the mandrel 200 of FIG. 1. The mandrel 200 comprises housings 230 in the perimeter of its surface which are located close to each of the ends 220*a* and 220*b* of the mandrel 200. When the actuator assembly/movement means 32 of the coupling means 31 is operated and moves the one or more pins/insertion means 33, the pins forming the insertion means 33 are coupled to the housings 230 of the mandrel 200, allowing the first pressure unit 30 and therefore also the second pressure unit 40 to rotate together with the mandrel 200 when the mandrel 200 is put in winding motion.

Figure 8:
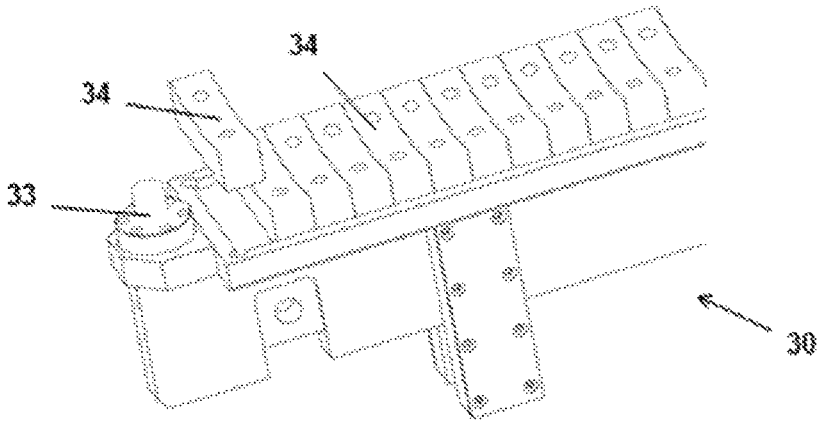
FIG. 8 shows a detailed view of the insertion means and a plurality of jaws of the first pressure unit of the device of FIG. 1 with a jaw removed from its position.

FIG. 8 shows a detailed view of the insertion means 33 and a plurality of jaws 34 according to one embodiment of the first pressure unit 30 of the device 100 of FIG. 1, with one jaw 34 shown removed from the first pressure unit 30. According to one embodiment each of the jaws comprised in the plurality of jaws 34 is easily removable to facilitate its replacement. Therefore, when the jaw units become worn due to use, for example, due to repeated use of a strip of a specific width, they can be individually replaced.

The pressure assembly 20 comprises a recovery assembly/recovery means 50 attached to the first pressure unit 30, and may, like the first pressure unit 30, occupy the length of the mandrel 200 on which the strip can be supported. The recovery assembly/recovery means 50 rotates with the first pressure unit 30 as it rotates from the first winding position to the second winding position. The recovery assembly/recovery means 50 comprises transmission means 51*a* and 51*b* which in the embodiment shown are pinion gears arranged at the end of a shaft, and pulling means 52 which in the embodiment shown is one or more electric geared motors that are attached to the shaft where the transmission means 51*a* and 51*b* are arranged and allows driving the transmission means 51*a* and 51*b*.

The second pressure unit 40 comprises pressure means 43 which in the embodiment of the device 100 shown in the figures is a freely rotating pressure roller which may occupy the length of the mandrel 200 on which the strip can be supported and allows pressing on the strip when the pressure means 43 is operated. The second pressure unit 40 also comprises a drive assembly/driving means 44 which in the embodiment of the device 100 shown is one or more hydraulic cylinders arranged such that they are fixedly attached to each end of the structure supporting the first pressure unit 30 and movably attached to the pressure means 43, and a brake/braking means 42 which in the embodiment shown is comprised of first and second pinion gears arranged such that they are fixedly attached to each of the ends of the pressure means 43.

Figure 7:
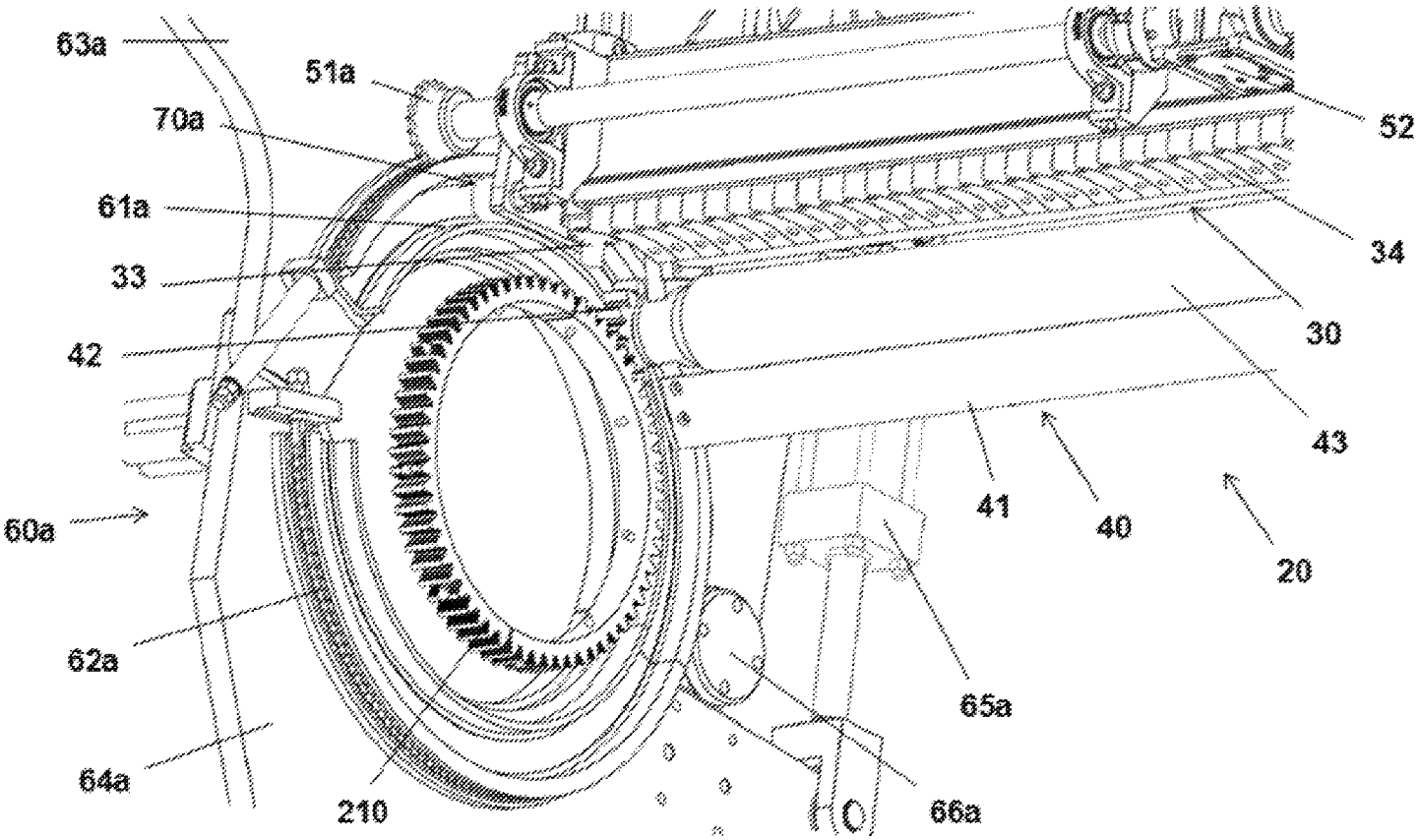
FIG. 7 shows a detailed perspective view of the device of FIG. 1 with the second pressure unit coupled to meshing means of the mandrel, and a transmission means of the recovery means coupled to a guiding means of one side of the device.

FIG. 7 shows a detailed perspective view of the device 100 of FIG. 1 with the second pressure unit 40 coupled to a gear/meshing means 210 of the mandrel 200, and the transmission means 51*a* of the recovery means 50 coupled to a guiding means 62*a* of one side 60*a* of the device 100.

When the pressure assembly 20 is in the second winding position, the driving means 44 are operated and drive the pressure means 43 against the strip supported on the surface of the mandrel 200. Therefore, the strip is pressed on by the pressure means 43 and the plurality of jaws 34 of the first pressure unit 30 can stop pressing on the strip. Since backward movement of the strip, which still has not made a complete turn over the surface of the mandrel, can occur, the brake/braking means 42 of the second pressure unit 40 comes into action. To that end, the mandrel 200 comprises in this embodiment of the device 100 the meshing means 210 which is a ring gear arranged at each of the ends 220*a* and 220*b* of the mandrel 200. When the driving means 44 of the second pressure unit 40 are operated, the pinion gears of the brake/braking means 42 are coupled to the ring gears of the meshing means 210 of the mandrel 200, and since the mandrel 200 does not move backward, the braking means 42 also do not move backward. In another embodiment of the device 100 (not shown in the drawings), the braking means 42 of the second pressure unit 40 is a hydraulic motor with brake attached to the pressure means 43, the meshing means 210 of the mandrel 200 not being required, since stopping the strip and preventing it from moving backward is achieved with the hydraulic motor with brake.

When the mandrel 200 starts to rotate again after stopping in the second winding position (after the jaws 34 of the first pressure unit 30 are moved radially away from the strip), the braking means 42 which has stopped the backward movement of the mandrel 200 allows forward movement of the strip in the winding direction. As a result of the pinion gear and ring gear relationship of the braking means 42 and meshing means 210, the pressure means 43 rotates along with the mandrel 200. Since the pressure means 43 is a freely rotating roller, the strip pressed on by the pressure means 43 is pulled along when the mandrel 200 rotates. In the embodiment of the device 100 in which the braking means 42 includes one or more hydraulic motors with a brake attached to the pressure means 43, this hydraulic motor would be what pulls the strip along, the hydraulic motor rotating in a synchronized manner with the mandrel 200.

In the embodiment shown in the figures, the device 100 also comprises two side plates 60*a* and 60*b* which laterally close the device 100 and are coupled to the ends 220*a* and 220*b* of the mandrel 200 respectively, giving way to the mandrel 200, and leaving the longitudinal section of the mandrel 200 on which the strip is wound free. Each of the side plates 60*a* and 60*b* comprises an upper side 63*a* and 63*b* and a lower side 64*a* and 64*b* respectively, each of the upper sides 63*a* and 63*b* and lower sides 64*a* and 64*b* having a semi-circumference in the area of attachment between both parts. When the upper side 63*a* and 63*b* and lower side 64*a* and 64*b* are coupled to the mandrel 200, they are attached together forming a circular opening which allows the passage of the mandrel 200. In this embodiment, each of the side plates 60*a* and 60*b* comprises opening means 65*a* and 65*b* which in this embodiment of the device 100 are hydraulic cylinders, that allow opening and closing the sides 60*a* and 60*b* surrounding the mandrel 200.

Figure 10:
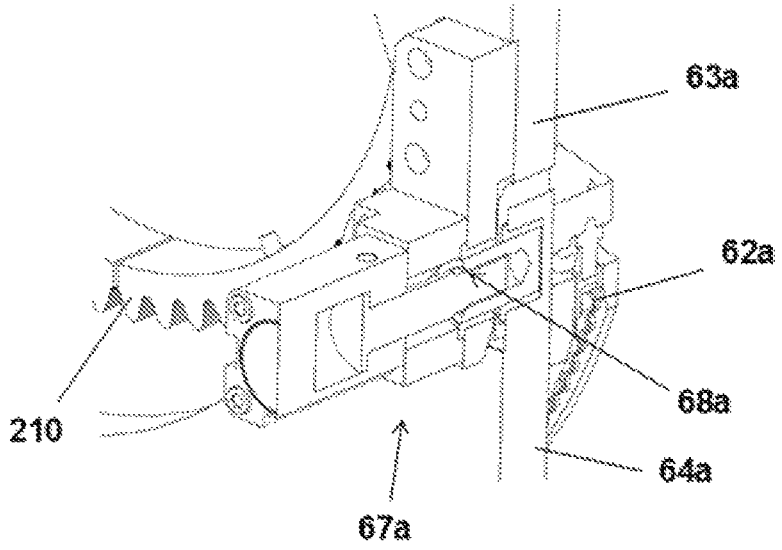
FIG. 10 shows a detailed view of a locking attachment attaching an upper side with a lower side of the device of FIG. 1.
Figure 11:
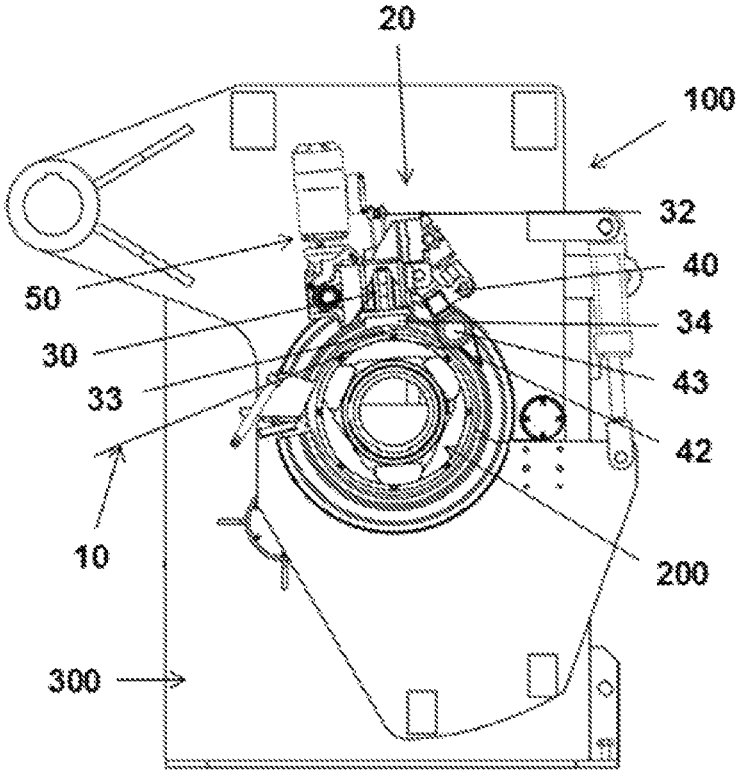
FIGS. 11 to 15 show the steps by which strips are wound on a mandrel according to one embodiment.

Each upper side 63*a* and 63*b* is attached to each lower side 64*a* and 64*b* respectively by means of a rotating attachment 66*a* and 66*b* at one end, acting like a hinge, and by means of a locking attachment 67*a* and 67*b* at the other end. FIG. 10 shows a detailed view of the locking attachment 67*a* attaching the upper side 63*a* and the lower side 64*a* of the device 100 of FIG. 1. Each locking attachment 67*a* and 67*b* comprises a pin 68*a* and 68*b* respectively, locking the closure of each upper side 63*a* and 63*b* with each lower side 64*a* and 64*b*.

Each side plate 60*a* and 60*b* comprises tracks 61*a* and 61*b* respectively in its inner part, where ends of the pressure assembly 20 is arranged. Each of these tracks 61*a* and 61*b* is arranged between the upper side 63*a* and 63*b* and the lower side 64*a* and 64*b* respectively and is formed by circular shaped plates that are made of metal or of another material and project orthogonally from the upper side 63*a* and 63*b* and lower side 64*a* and 64*b* respectively. These tracks 61*a* and 61*b* are arranged surrounding the mandrel 200 when the device 100 is coupled to and closed on the mandrel 200.

The pressure assembly 20 also comprises rolling elements 70*a* and 70*b* which are attached to the ends of the structure supporting the first pressure unit 30. In this embodiment of the device 100, each of these rolling elements 70*a* and 70*b* is a pair of wheels attached to a plate, this plate in turn being attached to the structure of the first pressure unit 30. When the device 100 is coupled to the mandrel 200, the rolling elements 70*a* and 70*b* are respectively assembled in the tracks (61*a* and 61*b*), such that when the first pressure unit 30 is coupled to the mandrel 200 and the mandrel 200 starts to rotate, due to the coupling of the rolling elements 70*a* and 70*b* to the tracks (61*a* and 61*b*), the first pressure unit 30 rotates in a manner coupled to the sides 60*a* and 60*b* of the device 100.

The side plates 60*a* and 60*b* also include meshing elements/guiding means 62*a* and 62*b* which in this embodiment of the device 100 are comprised in chains arranged attached to the tracks 61*a* and 61*b* respectively in the outer part of the radially outermost circular plate. When the device 100 is not coupled to the mandrel 200 and is open (as shown in FIG. 2), the pressure assembly 20 is coupled to the tracks 61*a* and 61*b* through the rolling elements 70*a* and 70*b* arranged in the tracks 51*a* and 51*b*, in the part corresponding to the upper sides 64*a* and 64*b*. In this arrangement, the transmission means 51*a* and 51*b* of the recovery means 50 are coupled with the guiding means 62*a* and 62*b* respectively, the pinion gears forming the transmission means 51*a* and 51*b* engaging with the chain forming the guiding means 62*a* and 62*b*. This coupling allows, when the device 100 is coupled to the mandrel 200 and the tracks 61*a* and 61*b* are configured, the transmission means 51*a* and 51*b* to move along the guiding means 62*a* and 62*b* by operating the pulling means 52 of the recovery means 50, allowing the first pressure unit 30 and therefore the pressure assembly 20 to move around the outer perimeter of the mandrel 200.

The device 100 must be coupled to the mandrel 200 to enable winding first turns of the strip on the surface of the mandrel 200, and the device 100 is decoupled and removed from the mandrel 200 when the first turns of the winding end, and the rest of the strip is then wound. To enable performing the movement for coupling, decoupling and removal, the device 100 comprises the articulated attachment 80 which is a set of articulated shafts which allow attaching the device 100 to the winding machine 300 and also allows guiding electric, signal and communication cables.

A winding method is implemented, for example, with a winding device 100 as shown in FIGS. 1-10 suitable for winding at least one strip 10 on a rotary mandrel 200 of a winding machine 300. The device 100 comprises a pressure assembly 20 pressing the strip 10 against the surface of the mandrel 200 when winding the strip 10, the pressure assembly 20 comprising a first pressure unit 30 which is coupled to and rotates together with the mandrel 200, from a first winding position to a second winding position, while the first pressure unit 30 presses on the strip 10. The second pressure unit 40 is attached to the first pressure unit 30 and presses on the strip 10 when the first pressure unit 30 reaches the second winding position, allowing forward movement of the strip 10 in the winding direction when the mandrel 200 rotates.

FIGS. 11-15 show the steps of an embodiment of a winding method for winding a strip 10 on the rotary mandrel 200 of the winding machine 300. The method comprises:

a first step of pressing on the strip 10, in which after coupling the device 100 to mandrel 200, the end of the strip 10 is supported on the surface of the mandrel 200, and the movement means 32 of the first pressure unit 30 are operated to move the insertion means 33 so as to be coupled to the housings 230 of the mandrel 200, and to move the plurality of jaws 34, such that the first pressure unit 30 which is in the first winding position presses on the strip 10 (see FIGS. 11 and 12), a first step of rotating the mandrel 200, in which the mandrel 200 starts to rotate pulling along the first pressure unit 30 and the second pressure unit 40, which is attached to the first pressure unit 30, and it pulls the strip 10 that starts to wind itself on the surface of the mandrel 200 along, the mandrel 200 being stopped when the first pressure unit 30 reaches the second winding position in the intersection of the first pressure unit 30 with the strip 10 (see FIG. 13), and a second step of pressing on the strip 10, in which the driving means 44 of the second pressure unit 40 are operated to drive the pressure means 43 and the braking means 42, such that the braking means 42 are coupled to the meshing means 210 of the mandrel 200, preventing backward movement of the second pressure unit 40, and the pressure means 43 press on the strip 10. The movement means 32 of the first pressure unit 30 are then no longer operated, being decoupled from the mandrel 200 and no longer pressing on the strip 10. Since the pressure means 43 of the second pressure unit 40 is freely rotating, it allows forward movement of the strip 10 in the winding direction when the mandrel 200 rotates (see FIG. 14).

The following steps are then carried out:

a second step of rotating the mandrel 200, in which the mandrel 200 starts to make turns until winding is assured, pulling the strip 10 along while making turns, the guiding of the strip 10 by the guiding means 41 of the second pressure unit 40 towards the surface of the mandrel 200 aiding in winding, the pressure assembly 20 with the first pressure unit 30 and the second pressure unit 40 being stationary in the second winding position, a step of recovering the pressure assembly 20, in which the driving means 44 of the second pressure unit 40 are no longer operated, the second pressure unit 40 no longer pressing on the strip 10, and the braking means 42 are no longer coupled to the meshing means 210 of the mandrel 200, the recovery means 50 is operated, the pulling means 52 starting to pull the transmission means 51*a* and 51*b* of the recovery means 50, the transmission means 51*a* and 51*b* being moved along the guiding means 62*a* and 62*b* of the sides 60*a* and 60*b* of the device 100, allowing the pressure assembly 20 to go back to the first winding position from the second position (see FIG. 15), and a step of winding the strip 10, in which the device 100 is removed from the mandrel 200, the strip 10 is given greater tension until reaching the winding tension, and the mandrel 200 continues to rotate winding the rest of the strip 10 on its surface.

What is claimed is:

1. An apparatus for winding a strip comprising:

a rotatable motor driven mandrel, the mandrel having an outer surface for supporting the strip, the mandrel rotatable about a central axis, a pressure assembly comprising:

a first pressure unit that is coupled to and rotates together with the mandrel about the central axis in a winding direction between a first winding position and a second winding position, the first pressure unit being configured to press down on a first portion of the strip as the mandrel and the first pressure unit rotate about the central axis from the first winding position to the second winding position, a second pressure unit that is attached to and rotates with the first pressure unit, the second pressure unit configured to press down on a second portion of the strip down against the outer surface of the mandrel after the first pressure unit reaches the second winding position, allowing forward movement of the strip in the winding direction when the mandrel rotates, the first pressure unit configured to stop pressing down on the first portion of the strip when the second pressure unit acts to press down on the second portion of the strip.

2. The apparatus according to claim 1, wherein the second pressure unit is arranged ahead of the first pressure unit in the winding direction.

3. The apparatus according to claim 2, wherein the second pressure unit includes a roller.

4. The apparatus according to claim 3, wherein the second pressure unit further comprises a guide element configured to guide the strip towards the outer surface of the mandrel.

5. The apparatus according to claim 3, wherein the second pressure unit comprises a brake that is configured to interact with the mandrel upon the first pressure unit reaching the second winding position to prevent the second pressure unit from rotating in a direction opposite the winding directing when the first pressure unit stops pressing down on the first portion of the strip, the brake allowing the mandrel to rotate in the winding direction.

6. The apparatus according to claim 5, wherein the mandrel is rotatable only in the winding direction.

7. The apparatus according to claim 5, wherein the brake is a pinion gear coupled with a ring gear arranged in the mandrel.

8. The apparatus according to claim 5, wherein the second pressure unit comprises a drive assembly attached to the first pressure unit and that is operable to move the roller between a first position and a second position, in the first position the roller is arranged to not press down on the second portion of the strip, in the second position the roller being arranged to press the second portion of the strip down against the mandrel.

9. The apparatus according to claim 1, wherein the first pressure unit is capable of being coupled to and decoupled from the mandrel, the first pressure unit comprising a pin that is moveable into and out of a housing located in the mandrel by an actuator assembly, when the pin is located inside the housing the first pressure unit rotates with the mandrel, when the pin is not located in the housing the first pressure unit does not rotate with mandrel.

10. The apparatus according to claim 9, wherein the actuator assembly is operably coupled to the first pressure unit to cause the first pressure unit to press down on the first portion of the strip when the pin is moved into the housing of the mandrel, and to cause the first pressure unit not to press down on the first portion of the strip when the pin is moved out of the housing of the mandrel.

11. The apparatus according to claim 9, wherein the first pressure unit comprises a plurality of jaws arranged along a length of the first pressure unit, the actuator assembly operably coupled to the plurality of jaws to cause the jaws to press down on the first portion of the strip when the pin is moved into the housing of the mandrel, and to cause the jaws not to press down on the first portion of the strip when the pin is moved out of the housing of the mandrel.

12. The apparatus according to claim 11, wherein the actuator assembly is configured to simultaneously move the pin and jaws.

13. The apparatus according to claim 11, wherein one or more of the plurality of jaws is individually removable from the first pressure unit.

14. The apparatus according to claim 1, further comprising a first side plate and a second side plate, each of the first and second side plates including an upper side and a lower side that are connect by a hinge connection, in a first position each of the upper and lower sides of the first and second side plates are closed around respective first and second ends of the mandrel, in a second position each of the upper and lower sides of the first and second side plates do not close around the respective first and second ends of the mandrel, the pressure assembly being located between the first and second side plates, the first and second side plates respectively including first and second tracks arranged surrounding the mandrel when the first and second side plates are in the first position, the pressure assembly comprising first and second rolling elements attached to the first pressure unit which are respectively housed within the first and second tracks, the rolling elements allowing rotation of the first pressure unit with respect to the mandrel.

15. The apparatus according to claim 14, wherein the pressure assembly includes a recovery assembly configured to move the pressure assembly from the second winding position to the first winding position, the recovery assembly having first and second ends that are respectively supported on the first and second side plates, the first end of the recovery assembly having a motor driven pinion gear that is engageable with meshing elements arranged on the first side plate, when rotated the pinion gear drives the pressure assembly from the first winding position to the second winding position.

16. The apparatus according to claim 15, wherein the meshing elements are comprised in a chain arranged on the first side plate and that at least partially circumscribes the mandrel.

17. The apparatus according to claim 14, further comprising first and second hydraulic actuators, the first hydraulic actuator having a first and second ends that are respectively attached to the upper and lower sides of the first side plate, the first hydraulic actuator configured to cause the upper and lower sides of the first side plate to move between the first and second positions, the second hydraulic actuator having a first and second ends that are respectively attached to the upper and lower sides of the second side plate, the second hydraulic actuator configured to cause the upper and lower sides of the second side plate to move between the first and second positions.

18. The apparatus according to claim 17, wherein the first and second hydraulic actuators are positioned adjacent the respective hinge connections of the first and second side plates.

19. The apparatus according to claim 14, wherein each of the upper and lower sides of the first and second side plates has a locking attachment for locking the upper and lower sides in the first position.

20. The apparatus according to claim 1, wherein the pressure assembly includes a recovery assembly configured to move the pressure assembly from the second winding position to the first winding position.

21. The apparatus according to claim 20, wherein the recovery assembly is attached to the first pressure unit.

* * * * *